US006770809B1

(12) United States Patent
De France

(10) Patent No.: US 6,770,809 B1
(45) Date of Patent: Aug. 3, 2004

(54) WILDLIFE PROTECTOR FOR ELECTRICAL POWER DISTRIBUTION AND SUBSTATION FACILITIES

(75) Inventor: Robert De France, Poughkeepsie, NY (US)

(73) Assignee: Delri LLC, Winsted, CT (US)

( * ) Notice: Subject to any disclaimer, the term of this patent is extended or adjusted under 35 U.S.C. 154(b) by 0 days.

(21) Appl. No.: 10/617,584

(22) Filed: Jul. 11, 2003

Related U.S. Application Data

(60) Provisional application No. 60/395,687, filed on Jul. 13, 2002.

(51) Int. Cl.[7] ..... H01B 17/00

(52) U.S. Cl. ..... 174/5 R; 174/138 R; 174/141 R

(58) Field of Search ..... 174/5 R, 31 R, 174/40 R, 137 R, 138 R, 139, 140 CR, 140 R, 141 R, 154, 155, 156, 167, 168

(56) References Cited

U.S. PATENT DOCUMENTS

| | | | | | |
|---|---|---|---|---|---|
| 3,639,678 | A | * | 2/1972 | Muschong | 174/5 R |
| 4,201,883 | A | * | 5/1980 | Shepherd | 174/5 R |
| 4,906,801 | A | * | 3/1990 | Beasley | 174/5 R |
| 5,446,242 | A | | 8/1995 | Barrett | |
| 5,552,566 | A | * | 9/1996 | Lin et al. | 174/140 CR |
| 5,648,641 | A | | 7/1997 | Guthrie | |
| 5,679,922 | A | * | 10/1997 | Harben | 174/5 R |
| 5,682,015 | A | * | 10/1997 | Harben | 174/5 R |
| 5,705,775 | A | * | 1/1998 | Ishihara et al. | 174/140 CR |
| 5,834,686 | A | * | 11/1998 | Barrett et al. | 174/5 R |
| 5,864,096 | A | | 1/1999 | Williams et al. | |
| 6,005,196 | A | * | 12/1999 | Spillyards | 174/138 R |
| 6,248,956 | B1 | * | 6/2001 | Cook et al. | 174/155 |
| 6,265,669 | B1 | * | 7/2001 | Richards | 174/141 C |
| 6,291,774 | B1 | * | 9/2001 | Williams | 174/5 R |
| 6,455,782 | B1 | * | 9/2002 | Lin et al. | 174/140 CR |

* cited by examiner

*Primary Examiner*—Dean A. Reichard
*Assistant Examiner*—Adolfo Nino
(74) *Attorney, Agent, or Firm*—Alix, Yale & Ristas, LLP

(57) ABSTRACT

A wildlife guard for live electrical power equipment to prevent wildlife from simultaneously contacting an electrically energized surface and an electrically grounded surface, which includes an arcuate member having a peripheral surface. An array of petals is carried on the arcuate member extend radially outward from the peripheral surface. Each of the petals is movable from a first position in which each of the petals is substantially coincident with a plane of the arcuate member and a second position that is oblique to the plane. Each of the petals is biased to a position that is substantially coincident with the plane. A pair of arcuate shoes are dimensioned and configured for engagement with an associated apparatus that is being protected.

27 Claims, 6 Drawing Sheets

WILDLIFE PROTECTOR FOR ELECTRICAL POWER DISTRIBUTION AND SUBSTATION FACILITIES

CROSS-REFERENCE TO RELATED APPLICATION

This application claims the priority of United States Provisional Application No. 60/395,687 filed on Jul. 13, 2002.

BACKGROUND OF THE INVENTION

This invention relates generally to electric power transmission and, more particularly, to guards for the protection of wildlife, such as squirrels, as well as protection of electrical power distribution and substation equipment.

While the apparatus of the present invention is particularly suitable for use with power distribution transformers installed on utility poles, those skilled in the art will recognize that it also has application to circuit breakers, capacitors, fuse cutouts, inductor insulators, underground cable terminators and other equipment commonly used in electrical power supply systems. Both wildlife and electrical power distribution and substation equipment are frequently destroyed when an animal simultaneously contacts grounded and electrically energized surfaces. In addition, a simultaneous contact usually results in a power outage that disrupts service to many customers. Customers are inconvenienced not only by the immediate lack of electric service but by the necessity for resetting clocks, videocassette recorders and the like. Electric utility companies also incur a significant expense as a result of such disruptive contacts. The expense may be for equipment, such as a transformer, as well as for the labor to stock, move and install replacement parts. Even if the replacement part is merely a fuse, the expense of dispatching trucks and personnel is still substantial.

The prior art includes various devices which have not been wholly satisfactory. They include an Electrostatic Animal Barrier for Electrical Equipment described in U.S. Pat. No. 5,648,641, issued to Guthrie on Jul. 15, 1997; an Insulating Shield described in U.S. Pat. No. 5,446,242, issued to Barrett on Aug. 29, 1995; and a Wildlife Guard described in U.S. Pat. No. 5,864,096, issued to Williams et al. on Jan. 26, 1999. The electrostatic apparatus of U.S. Pat. No. 5,648,641 utilizes projections in which an electrostatic charge is produced by current flow in the protected device. The electrostatic charge is relied on to discourage animals such as squirrels, from investigating and touching such apparatus. The other two noted devices are primarily rigid barrier devices.

Other prior art devices to which the invention relates have used a plastic enclosure in which two concave sections are hinged together. One section can be moved relative to the other to completely envelop a device such as a distribution transformer. At least some of the prior art devices have required service interruptions so the guard could be installed safely on the energized equipment. This is particularly a problem with unitary, one-piece structures. The installation of prior wildlife protective devices on distribution transformers may also be complicated by the close proximity of lightning arresting devices that may physically interfere with the installation of certain prior art devices.

SUMMARY OF THE INVENTION

An object of the invention is to provide new and improved protective apparatus that will more effectively and more humanely discourage animals from simultaneously contacting grounded and energized parts of electrical distribution apparatus.

Another object of the invention is to provide protective apparatus that can be installed safely on energized equipment in an efficient and cost effective manner.

Still another object of the invention is to provide protective apparatus for a power transformer that will not interfere with adjacent structures, for example, a lightning arrestor that is proximate to the power terminal of the distribution transformer.

It has now been found that these and other objects of the invention may be attained in a wildlife guard for live electrical power equipment to prevent wildlife from simultaneously contacting an electrically energized surface and an electrically grounded surface. The wildlife guide includes an arcuate member having a peripheral surface and a geometric axis that is perpendicular to the peripheral surface. An array of petals is carried on the arcuate member extending radially outward from the peripheral surface. Each of the petals is movable from a first position in which each of the petals is substantially coincident with a plane that is perpendicular to the geometric axis and extends through the member to a second position that is oblique to the plane.

In some forms of the wildlife guard apparatus, each of the petals is biased to a position that is substantially coincident with the plane. Each of the petals may be biased to a position that is substantially coincident with the plane by means of at least one spring. Various forms of springs may be employed. Each of the petals may also biased to a position that is substantially coincident with the plane by means of at least two springs.

In some embodiments, at least one arcuate shoe is dimensioned and configured for engagement with associated apparatus that is being protected. Other embodiments further include at least a second shoe dimensioned and configured for engagement with associated apparatus that is being protected. The first shoe and the second shoe may be disposed in opposed relationship.

The arcuate member may extend through an arc which is less than 360 degrees and have extremities that define a throat that is dimensioned and configured for passing around apparatus to be protected.

Each of the petals preferably have tapered generally planar surfaces and each of the petals carried on the arcuate ring may be disposed in closely spaced relationship to at least one other petal.

BRIEF DESCRIPTION OF THE DRAWING

The invention will be better understood by reference to the accompanying drawing in which.

DESCRIPTION OF THE PREFERRED EMBODIMENT

Figure 2:
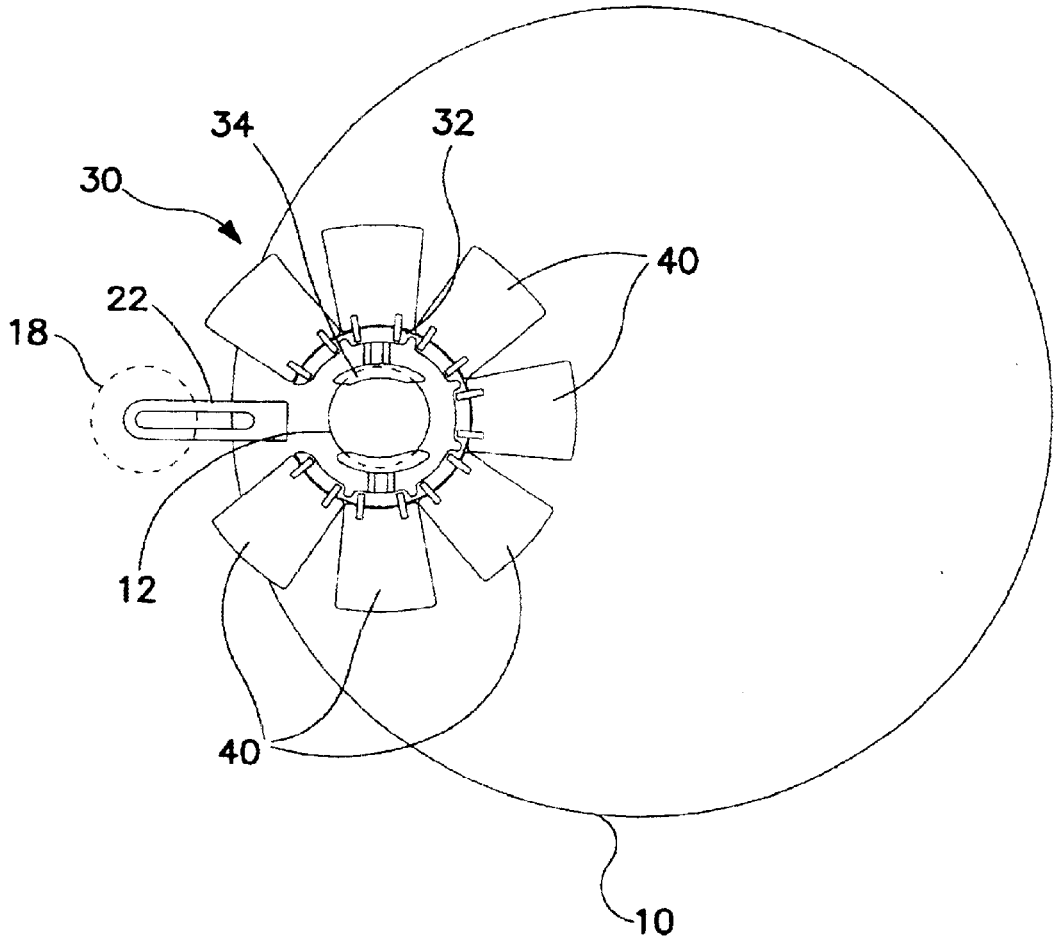
FIG. 2 is a simplified top plan view, partly in phantom, of the wildlife protector of FIG. 1 disposed on the top of a distribution transformer, namely an insulating bushing and terminal adjacent to a lightning arrestor.
Figure 3:
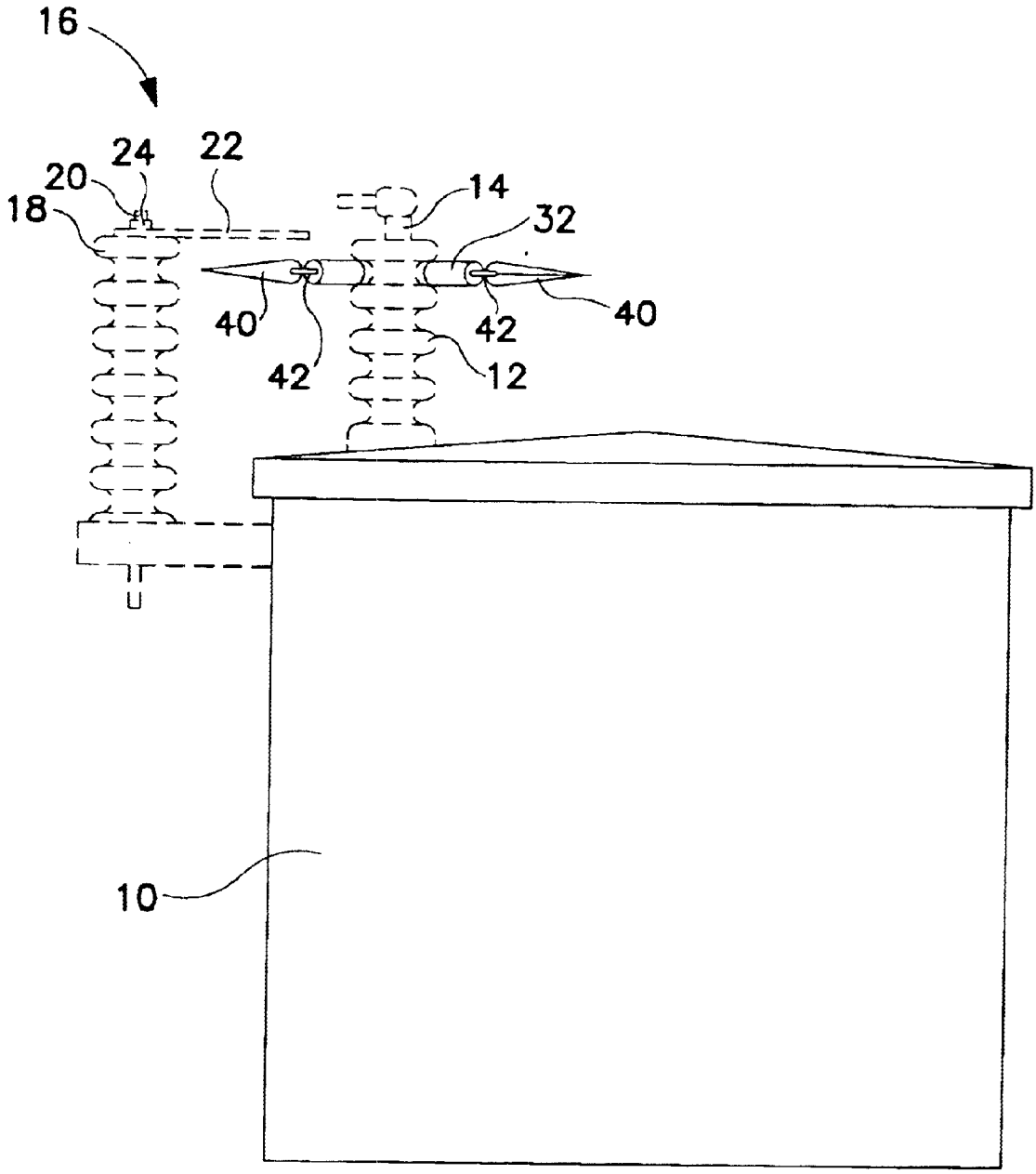
FIG. 3 is a simplified view, partially in cross-section and partially in schematic, taken along the line 3—3 of FIG. 1, illustrating two petals in the normal or horizontal position.
Figure 4:
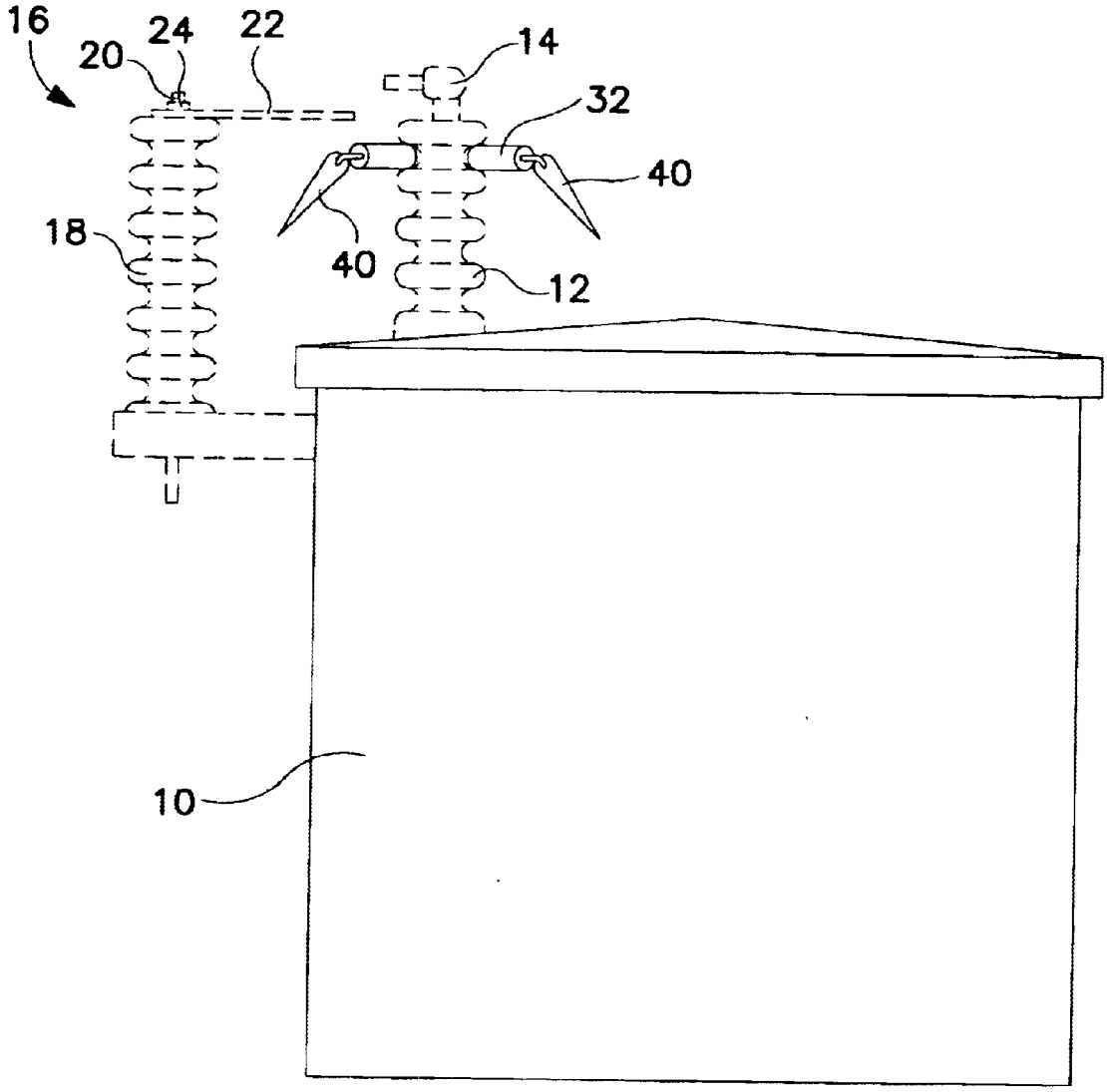
FIG. 4 is a simplified side elevation view, partially in schematic and similar to FIG. 3, illustrating two petals that are each depressed in response to external forces.

Although the present invention has application to a wide variety of power distribution and substation equipment, it will be described in terms of a distribution transformer 10 typically mounted on a utility pole. Referring now to FIGS. 2–4, such distribution transformers 10 have a generally cylindrical exterior structure. Typically, the distribution transformer 10 has an insulated primary bushing 12 having a terminal 14 disposed at the upper end. The terminal 14 is affixed to a conducting stud (not shown) which extends down through the bushing 12 and is secured within the distribution transformer.

A lightning arrestor 16 is disposed proximate to the terminal 14. The lightning arrestor 16 includes an insulated bushing 18 having a terminal 20 which is affixed to a conducting stud (not shown) which extends down through the bushing 18. A strap 22 is attached to the terminal 20 by a nut 24. In the event of a lightning strike, primary bushing 12 will dissipate electrical energy to the terminal without damaging the distribution transformer.

Figure 1:
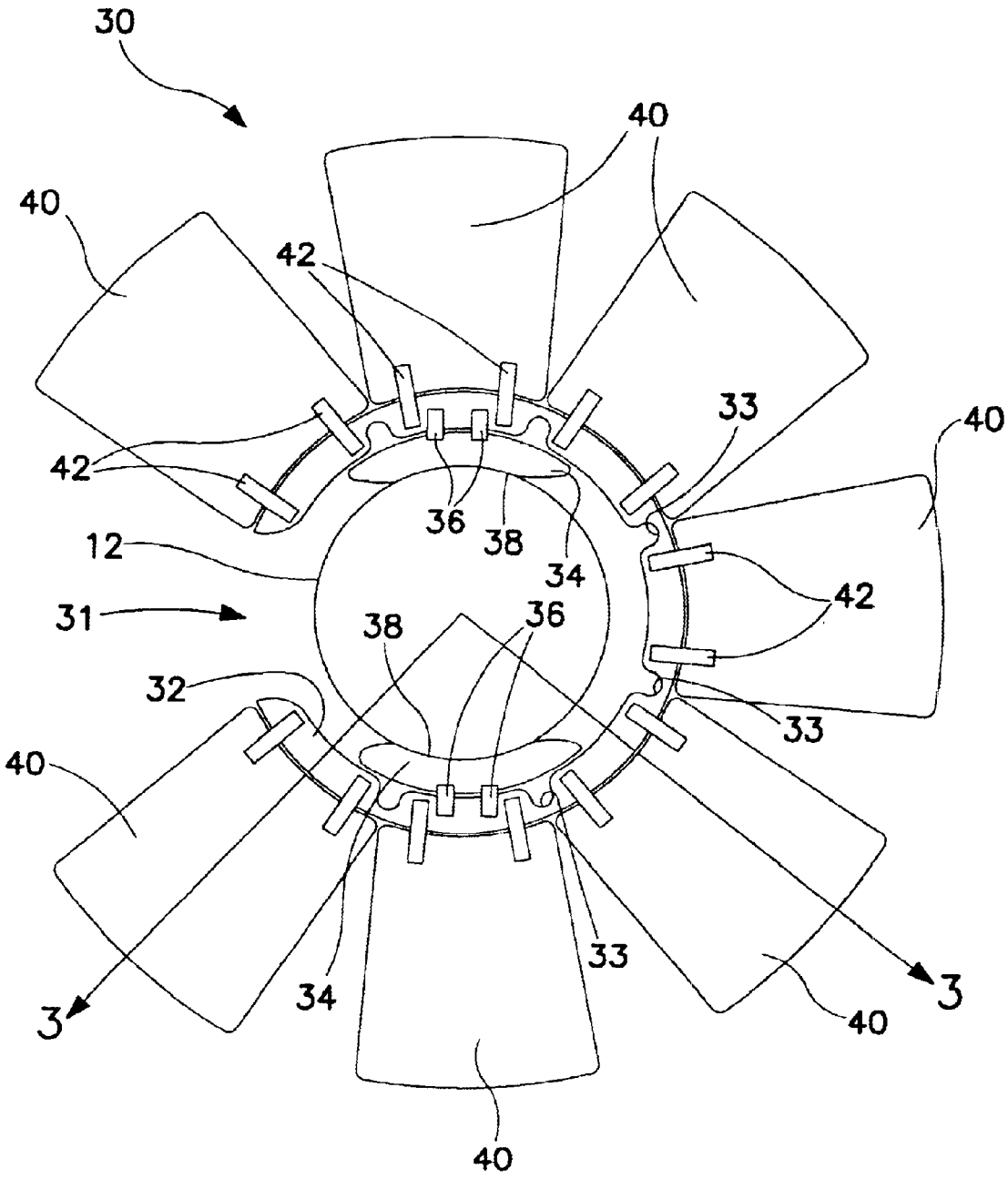
FIG. 1 is a top plan view of a wildlife protector in accordance with a preferred embodiment of the invention.

Referring now to FIGS. 1–2, a wildlife protector 30 comprises a somewhat flexible collar 32. The collar 32 is preferably made of a polymer material such as polyethylene having tolerance for ultraviolet light and which is flexible enough for installation and rigid enough to support an array of radially projecting petals 40. In the preferred embodiment the collar 32 has an angular extent of approximately 315 degrees. Thus, a throat is defined intermediate the extremities of the collar 32. The throat 31 has an angular extent of approximately 45 degrees. The collar may have recesses 33 to facilitate flexure (enlarge the throat) to aid in installation.

Two opposed arcuate shoes 34 are each mounted by first and second coil compression springs 36. The springs 36 are either pressed into bores in the petals 40 and ring collar or alternatively are secured by adhesives in the bores. The shoes 34 have an arcuate face 38 that is dimensioned and configured engagement with the annular recesses of the insulating bushing 12 on the top of a cylindrical distribution transformer 10 (FIG. 2). In some cases, the arcuate faces 38 may have a rubber or other non-slip surface to improve the engagement with the bushing 12 of the cylindrical distribution transformer 10.

Figure 6:
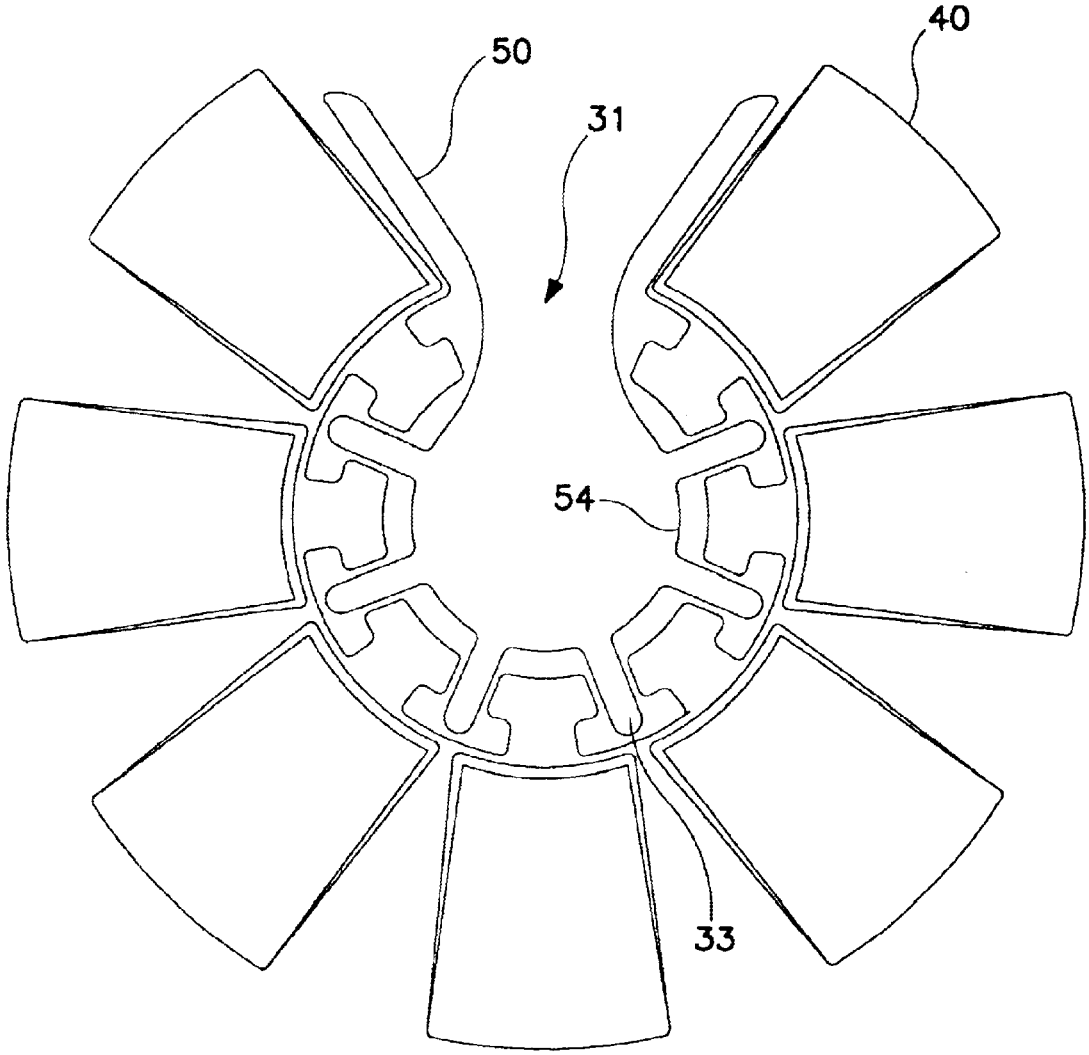
FIG. 6 is a top view of one embodiment of the invention, illustrating an example of throat extenders.

In one embodiment of the invention, the collar 32 may be formed without the arcuate shoes as shown in FIG. 6. The collar 32 has a face 54 which is integrally formed or adhered with the collar 32. The collar recesses 33 may be formed such that they extend further to the petal side of the collar 32. This is to provide flexure for such things as a harder or more rigid polymeric material during installation involving the bushing 12 of the cylindrical distribution transformer 10.

Secured to the outer periphery of the collar 32 are seven substantially identical petals 40. The petals 40 are generally tapered members which may have convergent generally planar surfaces. The number of petals and specific shape may vary. The petals 40 need not be substantially identical. Each petal 40 is manufactured of plastic or aluminum that is intentionally a slippery surface. The surface is inherently slippery and in some cases may be coated to be made even more slippery.

Figure 5:
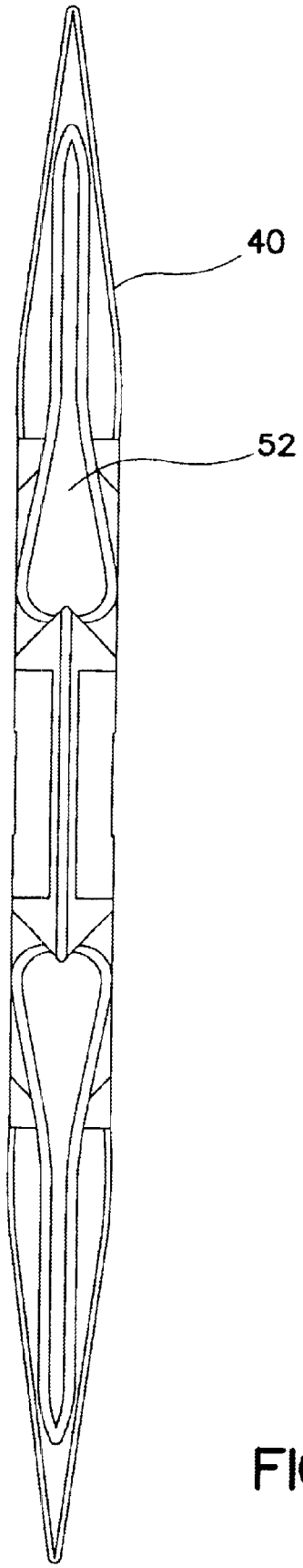
FIG. 5 is a side view, partially in cut way, illustrating one embodiment of the invention.

The petals 40 are each preferably secured to the outer periphery of the collar 32 by means of one or more angularly spaced springs 42 as shown in FIGS. 1, 2 and 3. An axial part of each spring 42 is fixed to the ring 32. Another axial part of each spring 42 is fixed to one of the petals 40. The springs 42 are either pressed into bores in the petals 40 and the collar 32 or are fixed in the bores by adhesive or may be molded in. Thus, as seen in FIG. 3, the petals 40 have a stable position that in normal state is horizontal. Other spring or biasing elements may alternately be employed in place of spring 42. As shown in FIG. 5, the petals 40 may have a hollow region 52 to reduce the overall weight of the petal. This weight reduction allows for the petal to be more responsive to any interaction with wildlife.

The wildlife protector 30 is installed on the bushing 12 by passing the bushing 12 through the throat 31 of the collar 32 so that the bushing 18 of the lightning protector is positioned at or adjacent to the throat of the collar 32. FIG. 6 shows one embodiment of the invention wherein there are throat extenders 50 that extend outward from the central axis of the protector 30. The extenders 50 allow for ease of installation since they provide a guiding surface for the bushing 12 as the protector 30 is installed. The features of the protector can best be described and appreciated with reference to a squirrel, which is undoubtedly the wildlife animal most often involved in transformer mishaps. Thus, when the wildlife protector 30 is installed and a squirrel climbs to the top of the distribution transformer 10, the squirrel will be unable to reach the terminal 14.

More particularly, the squirrel will not be able to approach the primary terminal 14 through the throat of the ring 32 because, for example, the wildlife protector and bushing 18 will block the path of the squirrel. In addition, the squirrel will be unable to reach the terminal 14 because the petals 40 will block all other paths. More particularly, as the squirrel attempts to proceed to the terminal 14, which is disposed at the geometric center of the wildlife protector 30, the squirrel will apply pressure to a slippery petal 40. The pressure applied to any petal 40 will cause that petal to move from the null or stable horizontal position illustrated in FIG. 3, to the downwardly deflected oblique position illustrated in FIG. 4. Because of the slippery surface of the individual petals 40, the squirrel will not be able to climb upward toward the terminal 14. As soon as the squirrel removes the pressure from a petal 40, that petal will move from the deflected oblique position illustrated in FIG. 3 to the null horizontal position illustrated in FIG. 2. Thus, the squirrel will be prevented from accessing the primary terminal 14.

While the invention has particular application to electrical power distribution and substation equipment, it will be understood that the apparatus that isolates the equipment from wildlife while protecting the wildlife in accordance with the present invention has application to many other articles of manufacture.

The invention has been described with reference to the preferred embodiment. Persons skilled in the art of such inventions may upon exposure to the teachings herein, conceive other variations. Such variations are deemed to be encompassed by the disclosure, the invention being delimited only by the following claims.

What is claimed is:

1. A wildlife guard for live electrical power equipment to prevent wildlife from simultaneously contacting an electrically energized surface and an electrically grounded surface, which wildlife guard comprises:

an arcuate collar having a peripheral surface and defining a central geometric axis; and an array of petals carried on said arcuate collar extending radially outward relative to said peripheral surface, each of said petals being pivotally displaceable from a first position in which each of said petals is substantially coincident with a plane that is perpendicular to said geometric axis and extends through said collar to a second position that is oblique to said plane.

2. The wildlife guard in accordance with claim 1, wherein each of said petals is biased to said first position.

3. The wildlife guard in accordance with claim 2, wherein each of said petals is biased to said first position by means of at least one spring.

4. The wildlife guard in accordance with claim 3, wherein said at least one spring is interpositioned between said collar and a petal.

5. The wildlife guard in accordance with claim 4, wherein said at least one spring has at least an axial portion thereof fixed to said collar and at least a second axial portion thereof is fixed to one of said petals.

6. The wildlife guard in accordance with claim 2, wherein each of said petals is biased to said first position by means of at least two springs.

7. The wildlife guard in accordance with claim 1, further including at least one arcuate shoe supported by said collar and disposed radially inwardly thereto.

8. The wildlife guard in accordance with claim 7, further including at least a second shoe supported by said collar and disposed radially inwardly thereto.

9. The wildlife guard in accordance with claim 8, wherein said first shoe and said second shoe are disposed in opposed relationship.

10. The wildlife guard in accordance with claim 1, wherein said arcuate collar extends through an arc that is less than 360 degrees.

11. The wildlife guard in accordance with claim 10, wherein the arcuate collar has extremities that define a throat which subtends an angle of approximately 45 degrees.

12. The wildlife guard in accordance with claim 1, wherein each of said petals has an upper face that is generally planar.

13. The wildlife guard in accordance with claim 1, wherein each of said petals carried on said arcuate collar is disposed in closely spaced relationship to at least one other petal.

14. A wildlife guard for live electrical power equipment to prevent wildlife from simultaneously contacting an electrically energized surface and an electrically grounded surface, which comprises:

an arcuate collar having a peripheral surface and defining a plane and a geometric axis that is perpendicular to said plane; and an array of petals carried on said arcuate collar extending radially outward relative to said peripheral surface, each of said petals being pivotally displaceable from a first position in which each of said petals is substantially coincident with said plane to a second position that is oblique to said plane, each of said petals carried on said arcuate collar being disposed in closely spaced relationship to at least one other petal and each of said petals having a face that is generally planar.

15. The wildlife guard in accordance with claim 14, wherein each of said petals is biased to a position that is substantially coincident with said plane.

16. The wildlife guard in accordance with claim 15, wherein each of said petals is biased to a position that is substantially coincident with said plane by means of at least one spring.

17. The wildlife guard in accordance with claim 14, further including a pair of opposed arcuate shoes supported by said collar and disposed radially inwardly from said collar.

18. The wildlife guard in accordance with claim 17, further comprising a spring for biasing each shoe inwardly away from said collar.

19. The wildlife guard in accordance with claim 18, wherein said first shoe and said second shoe each are mounted to said collar by at least one coil spring.

20. The wildlife guard in accordance with claim 19, wherein the arcuate collar has extremities that define a throat that is dimensioned and configured for passing around apparatus to be protected.

21. A power distribution system comprising:

a transformer for an electrical power supply having an insulated bushing defining an axis and extending axially from the top surface thereof; and a wildlife guard to prevent wildlife from simultaneously contacting an electrically energized surface and an electrically grounded surface of said transformer comprising an arcuate member having a peripheral surface and defining a plane that is perpendicular to said axis, an array of petals carried on said arcuate member extending radially outward from said peripheral surface, each of said petals being pivotally displaceable from a first position in which each of said petals is substantially coincident with said plane and a second position that is oblique to said plane and further including at least one shoe mounted to said member and dimensioned and configured for engagement with said insulated bushing.

22. The system in accordance with claim 21, wherein there are two shoes disposed in opposed relationship.

23. The system in accordance with claim 22, wherein said shoes are biased into engagement with said insulated bushing.

24. The system in accordance with claim 21, wherein each of said petals is biased to a position that is substantially coincident with said plane.

25. The system in accordance with claim 21, wherein said arcuate member extends through an arc that is less than 360 degrees.

26. The system in accordance with claim 21, wherein said arcuate member has extremities that define a throat that is dimensioned and configured for passing around a part of said bushing.

27. The system in accordance with claim 21, wherein each of said petals carried on said arcuate member is disposed in closely spaced relationship to at least one other petal.

* * * * *